US011149371B2

(12) United States Patent
Woo et al.

(10) Patent No.: US 11,149,371 B2
(45) Date of Patent: Oct. 19, 2021

(54) WASHING MACHINE AND CONTROL METHOD THEREOF

(71) Applicant: Samsung Electronics Co., Ltd., Suwon-si (KR)

(72) Inventors: Ji Hyun Woo, Seoul (KR); Ji-Yu Lee, Incheon (KR); Sang Up Lee, Yongin-si (KR); Sang Yeon Pyo, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 78 days.

(21) Appl. No.: 16/349,415

(22) PCT Filed: Oct. 19, 2017

(86) PCT No.: PCT/KR2017/011610
§ 371 (c)(1),
(2) Date: May 13, 2019

(87) PCT Pub. No.: WO2018/097482
PCT Pub. Date: May 31, 2018

(65) Prior Publication Data

US 2019/0360142 A1 Nov. 28, 2019

(30) Foreign Application Priority Data

Nov. 23, 2016 (KR) ..... 10-2016-0156168

(51) Int. Cl.
*D06F 33/00* (2020.01)
*D06F 37/30* (2020.01)
(Continued)

(52) U.S. Cl.
CPC ..... *D06F 33/00* (2013.01); *D06F 34/18* (2020.02); *D06F 37/306* (2013.01); *D06F 37/40* (2013.01);
(Continued)

(58) Field of Classification Search
None
See application file for complete search history.

(56) References Cited

U.S. PATENT DOCUMENTS

2007/0289607 A1* 12/2007 Kim ..... D06F 33/36 134/18
2010/0138055 A1* 6/2010 Jun ..... D06F 33/00 700/282
(Continued)

FOREIGN PATENT DOCUMENTS

CN 101113557 A 1/2008
KR 10-2008-0109488 A 12/2008
(Continued)

OTHER PUBLICATIONS

Espacenet translation KR 10-2015-0030806 Washing Machine, Gee, 2015, (Year: 2015).*
(Continued)

*Primary Examiner* — Cristi J Tate-Sims
(74) *Attorney, Agent, or Firm* — Jefferson IP Law, LLP

(57) ABSTRACT

A washing machine including an auxiliary washing tub in a washing tub, and a method for controlling the same are disclosed. The washing machine includes a main washing tub and an auxiliary washing tub through which different laundry can be classified according to the weight or category of laundry such that the classified laundry can be separately washed. As a result, user convenience increases, and the entire washing time and unnecessary energy consumption can be reduced. When the main washing tub and the auxiliary washing tub are simultaneously operated, when only the main washing tub is independently operated, or when only the auxiliary washing tub is independently operated, laundry can be effectively washed in different ways in the washing tub and the auxiliary washing tub according to an optimum washing algorithm achieved by a combination
(Continued)

of washing-tub rotation and pulsator rotation, such that laundry can be less damaged and washing performance can be improved.

15 Claims, 10 Drawing Sheets

(51) Int. Cl.
*D06F 37/40* (2006.01)
*D06F 39/08* (2006.01)
*D06F 34/18* (2020.01)

(52) U.S. Cl.
CPC ..... *D06F 39/087* (2013.01); *D06F 2202/085* (2013.01); *D06F 2202/10* (2013.01)

(56) References Cited

U.S. PATENT DOCUMENTS

2012/0167314 A1* 7/2012 Kim ..... D06F 39/088 8/137
2015/0184326 A1* 7/2015 Seo ..... D06F 37/20 68/132
2018/0087198 A1* 3/2018 Kim ..... D06F 39/045

FOREIGN PATENT DOCUMENTS

KR 10-2015-0025734 A 3/2015
KR 10-2015-0030806 A 3/2015
KR 10-2015-0077059 A 7/2015
KR 10-2016-0118124 A 10/2016
KR 10-2016-0127676 A 11/2016

OTHER PUBLICATIONS

Chinese Office Action dated Nov. 4, 2020, issued in Chinese Application No. 201780067958.4.
Chinese Office Action dated May 10, 2021, issued in Chinese Patent Application No. 201780067958.4.

* cited by examiner

FIG. 9

| ROTATION OF PULSATOR | | | ROTATION OF WASHING TUB | | | ROTATION OF PULSATOR | | | ROTATION OF WASHING TUB | | | ROTATION OF PULSATOR | | | ROTATION OF WASHING TUB | | | ROTATION OF PULSATOR | | | ROTATION OF WASHING TUB | | | ROTATION OF PULSATOR | | |
|---|---|---|---|---|---|---|---|---|---|---|---|---|---|---|---|---|---|---|---|---|---|---|---|---|---|---|
| WASHING 1 | | | WASHING 2 | | | WASHING 3 | | | WASHING 4 | | | WASHING 5 | | | WASHING 6 | | | WASHING 7 | | | WASHING 8 | | | WASHING 9 | | |
| OPERATE PULSATOR | | | ROTATE TUB IN LEFT-RIGHT DIRECTION | | | OPERATE PULSATOR | | | ROTATE TUB IN LEFT-RIGHT DIRECTION | | | OPERATE PULSATOR | | | ROTATE TUB IN LEFT-RIGHT DIRECTION | | | OPERATE PULSATOR | | | ROTATE TUB IN LEFT-RIGHT DIRECTION | | | OPERATE PULSATOR | | |
| 4 MINUTES | | | 3 MINUTES | | | 4 MINUTES | | | 4 MINUTES | | | 4 MINUTES | | | 4 MINUTES | | | 4 MINUTES | | | 4 MINUTES | | | 2 MINUTES | | |
| rpm | ON | OFF | rpm | ON | OFF | rpm | ON | OFF | rpm | ON | OFF | rpm | ON | OFF | rpm | ON | OFF | rpm | ON | OFF | rpm | ON | OFF | rpm | ON | OFF |
| 120 | 1.1 | 0.8 | 90 | 2.5 | 3.0 | 120 | 1.1 | 0.8 | 90 | 2.5 | 3.0 | 120 | 1 | 0.7 | 90 | 2.5 | 3.0 | 120 | 1 | 0.7 | 90 | 2.5 | 3.0 | 120 | 1 | 0.7 |

WASHING MACHINE AND CONTROL METHOD THEREOF

TECHNICAL FIELD

Embodiments of the present disclosure relate to a washing machine including an auxiliary washing tub in a washing tub, and a method for controlling the washing machine.

BACKGROUND ART

A washing machine (for example, a fully automatic washing machine) includes a tub to store water such as washing water or rinsing water, a washing and dehydrating tub (hereinafter, referred to as a "washing tub") rotatably installed in the tub to accommodate laundry therein, a pulsator rotatably installed in the washing tub to generate streams of water, and a motor to generate a driving force for rotating the washing tub and the pulsator. The washing machine removes contaminants from laundry with help of streams of water and surface activities of detergent.

In recent times, an auxiliary washing tub is installed in a washing tub to wash laundry separately according to the kinds of the laundry. There are cases in which washing all laundry at once in one tub is not preferable since the types of laundry are various and many kinds of laundry are made of different materials. In these cases, such different types and materials of laundry need to be washed separately. However, washing laundry separately causes a user's inconvenience, and also results in wastes of time and energy since it is required to operate the washing machine several times (for example, two times). Also, there is a case of washing a small amount of laundry in a large-capacity washing tub, which also causes an unnecessary waste of power due to driving of the large-capacity washing tub.

DISCLOSURE

Technical Problem

Therefore, it is an aspect of the present disclosure to provide a washing machine including an auxiliary washing tub in a washing tub to wash laundry separately according to volumes or kinds of the laundry, and a method of controlling the washing machine.

It is another aspect of the present disclosure to provide a washing machine capable of effectively washing laundry separately in the washing tub and the auxiliary washing tub according to an optimum washing algorithm achieved by a combination of a rotation of the washing tub and a rotation of a pulsator, and a method of controlling the washing machine.

Additional aspects of the invention will be set forth in part in the description which follows and, in part, will be obvious from the description, or may be learned by practice of the invention.

Technical Solution

In accordance with an aspect of the present disclosure, a washing machine includes: a cabinet; a tub disposed in the cabinet, and configured to accommodate water therein; a main washing tub rotatably disposed in the tub, and configured to accommodate laundry therein; a pulsator rotatably disposed in the main washing tub; an auxiliary washing tub detachably coupled to the main washing tub, and configured to accommodate laundry therein; and a controller configured to perform a washing course algorithm in which rotation of the pulsator and rotation of the main washing tub are alternately performed, repeatedly perform the alternate washing course algorithm several times, and control separate washing of the main washing tub and the auxiliary washing tub.

The washing machine may further include: a detector configured to detect whether the auxiliary washing tub is installed in the main washing tub, wherein the controller performs any one of a first washing mode in which washing is simultaneously performed in the main washing tub and the auxiliary washing tub and a second washing mode in which washing is performed only in the auxiliary washing tub, when the auxiliary washing tub is installed in the main washing tub.

The controller may determine whether laundry is present in the main washing tub by detecting a weight of the main washing tub, performs the first washing mode when the laundry is present in the main washing tub, and performs the second washing mode when the laundry is not present in the main washing tub.

The controller may perform washing only in the main washing tub when the auxiliary washing tub is not installed in the main washing tub.

The controller may perform at least one of the first washing mode, the second washing mode, and the third washing mode according to installation or non-installation of the auxiliary washing tub and the detected weight of the main washing tub.

The washing machine may further include: a water supply apparatus installed at an upper portion of the cabinet, and configured to supply water to the main washing tub and the auxiliary washing tub, wherein the controller supplies water to the auxiliary washing tub by controlling the amount of water supplied from the water supply apparatus, and supplies water to the main washing tub by controlling a water level of the tub.

The controller may perform a rotational water supply operation for wetting the laundry by rotating the main washing tub when water is supplied to the main washing tub.

The washing machine may further include: a motor configured to rotate the pulsator and the main washing tub, wherein the controller controls the motor, and thus alternately rotates the pulsator in a first direction and in a second direction opposite to the first direction during a predetermined time.

The controller may control the motor, and thus alternately rotates the main washing tub in a first direction and in a second direction opposite to the first direction during a predetermined time.

The washing machine may further include: an input portion configured to select a washing course, wherein the controller changes rotation of the pulsator and rotation of the main washing tub by controlling an operation rate and operation time of the motor according to the washing course and a washing load.

In accordance with an aspect of the present disclosure, a method for controlling a washing machine including a tub, a main washing tub rotatably disposed in the tub to accommodate laundry therein, a pulsator rotatably disposed in the main washing tub, and an auxiliary washing tub detachably coupled to the main washing tub to accommodate laundry therein, the method includes: determining whether the auxiliary washing tub is installed; determining whether laundry is present in the main washing tub by detecting a weight of the main washing tub when the auxiliary washing tub is installed; and when laundry is present in the main washing tub, performing a separate washing operation in the main washing tub and the auxiliary washing tub, wherein the separate washing operation repeatedly performs a washing course algorithm in which rotation of the pulsator and rotation of the main washing tub are alternately performed such that laundry of the main washing tub and laundry of the auxiliary washing tub are alternately washed.

The method may further include: when the auxiliary washing tub is not installed in the main washing tub, performing washing only in the main washing tub.

The method may further include: when laundry is not present in the main washing tub, performing washing only in the auxiliary washing tub.

The method may further include: supplying water to the main washing tub and the auxiliary washing tub, wherein the supplying water to the auxiliary washing tub includes: supplying water to the auxiliary washing tub by controlling the amount of water supplied to the auxiliary washing tub, and wherein the supplying water to the main washing tub includes: supplying water to the main washing tub by controlling a water level of water supplied to the main washing tub.

The method may further include: rotating the main washing tub when water is supplied to the main washing tub, thereby wetting the laundry with water.

The method may further include: selecting a washing course by a user, wherein the separate washing operation changes an operation rate and operation time of the motor for rotating the pulsator and the main washing tub according to the washing course.

The separate washing operation may change the operation rate and operation time of the motor according to the washing course and the weight of the main washing tub, and may control rotation of the pulsator and rotation of the main washing tub.

In accordance with another aspect of the present disclosure, a method for controlling a washing machine including a tub, a main washing tub rotatably disposed in the tub to accommodate laundry therein, a pulsator rotatably disposed in the main washing tub, and an auxiliary washing tub detachably coupled to the main washing tub to accommodate laundry therein, the method includes: determining whether the auxiliary washing tub is installed; determining whether laundry is present in the main washing tub by detecting a weight of the main washing tub when the auxiliary washing tub is installed; and when laundry is present in the main washing tub, supplying water to the auxiliary washing tub and the main washing tub; alternately rotating the pulsator in a first direction and in a second direction opposite to the first direction during a predetermined time; and alternately rotating the main washing tub in a first direction and in a second direction opposite to the first direction during a predetermined time, wherein a washing course algorithm in which rotation of the pulsator and rotation of the main washing tub are alternately performed is repeatedly performed several times such that separate washing is performed in the main washing tub and the auxiliary washing tub.

Advantageous Effects

Therefore, it is an aspect of the present disclosure to provide a washing machine including an auxiliary washing tub in a washing tub to wash laundry separately according to volumes or kinds of the laundry, and a method of controlling the washing machine.

It is another aspect of the present disclosure to provide a washing machine capable of effectively washing laundry separately in the washing tub and the auxiliary washing tub according to an optimum washing algorithm achieved by a combination of a rotation of the washing tub and a rotation of a pulsator, and a method of controlling the washing machine.

Additional aspects of the invention will be set forth in part in the description which follows and, in part, will be obvious from the description, or may be learned by practice of the invention.

DESCRIPTION OF DRAWINGS

FIG. 9 is a view illustrating a washing course profile acquired by a combination of rotation of the pulsator and rotation of the main washing tub in a simultaneous washing mode of the washing machine according to the embodiment of the present disclosure.

BEST MODE

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, the terms used in the present specification are used for describing the embodiments of the present disclosure, not for the purpose of limiting and/or restricting the invention. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, the embodiments of the present disclosure will be described in detail with reference to the accompanying drawings.

Figure 1:
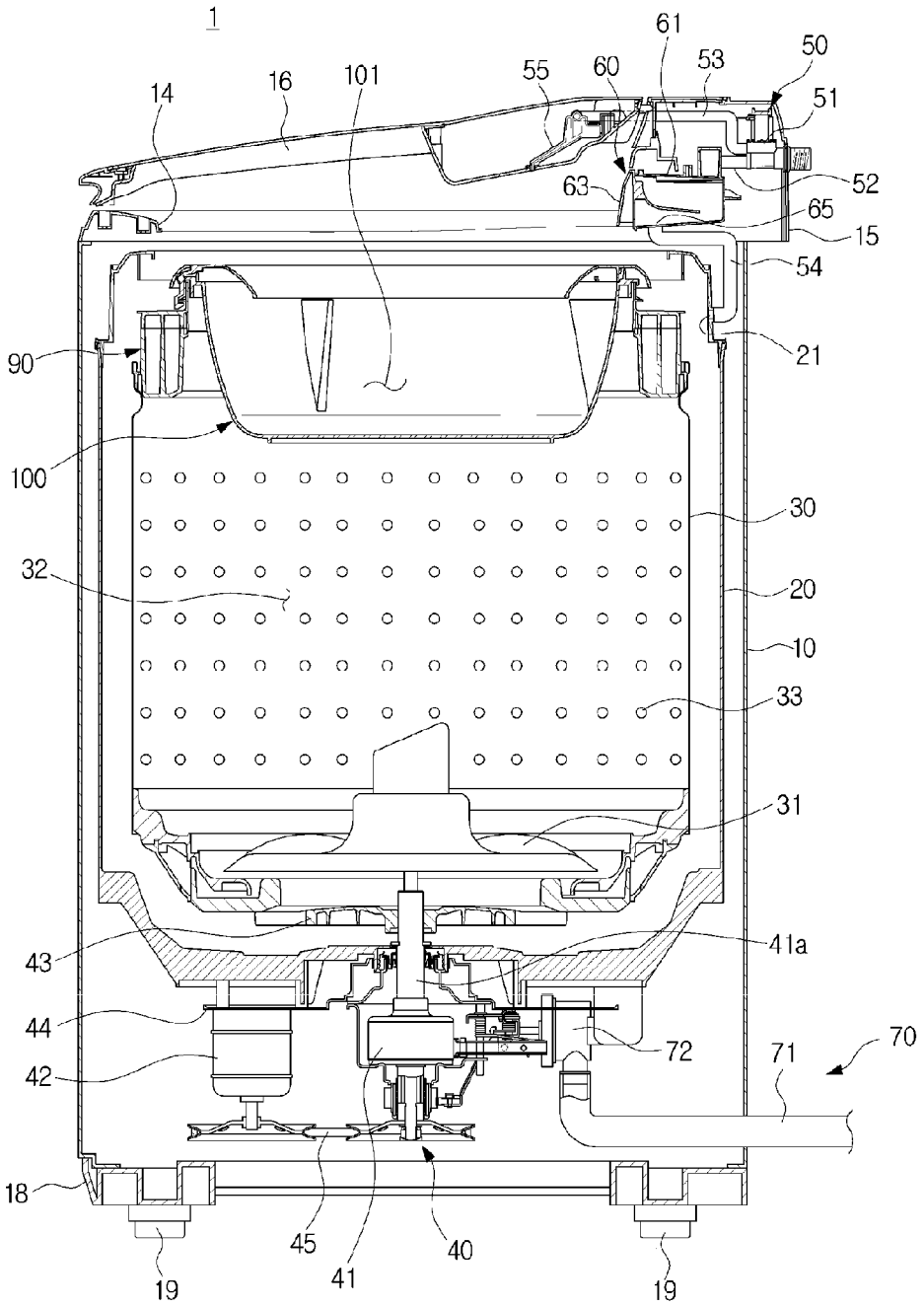
FIG. 1 is a view illustrating a washing machine according to an embodiment of the present disclosure.

FIG. 1 shows a configuration of a washing machine according to an embodiment of the present disclosure.

Referring to FIG. 1, a washing machine 1 may include a cabinet 10 forming an external appearance of the washing machine 1 to accommodate various kinds of components therein, a tub 20 installed in the cabinet 10 to accommodate water (washing water or rinsing water) to be used for a washing course or a rinsing course, a main washing tub 30 rotatably disposed in the tub 20 to accommodate laundry therein, and a driving apparatus 40 to rotate the main washing tub 30.

The cabinet 10 may include an upper cover 15 and a lower cover 18.

In the upper cover 15, an inlet 14 through which laundry is put into the main washing tub 30 may be formed. The upper cover 15 may include a door 16 to open and close the inlet 14.

The lower cover 18 may be connected to a ground portion 19 configured to fix the washing machine 1 on the floor.

A water supply apparatus 50 for supplying water (washing water or rinsing water) to the main washing tub 30 and the auxiliary washing tub 100 may be installed at the upper portion of the cabinet 10.

The tub 20 may be installed in the cabinet 10 to accommodate water (washing water or rinsing water) therein. The tub 20 may be supported on the cabinet 10 by a suspension member (not shown). A water supply hole 21 may be formed in the upper portion of the tub 20.

The main washing tub 30 may be rotatably installed in the tub 20. The main washing tub 30 may include first washing space 32 therein. A pulsator 31 may be rotatably installed at the bottom of the main washing tub 30. The pulsator 31 may agitate laundry entered the inside of the main washing tub 30 with washing water. That is, the pulsator 31 may agitate laundry accommodated in the first washing space 32 with washing water.

A plurality of through holes 33 may be formed in the side of the main washing tub 30. Water may move from the main washing tub 30 to the tub 20 or from the tub 20 to the main washing tub 30 through the through holes 33.

A balancer 90 may be provided at the upper portion of the main washing tub 30. The balancer 90 may include one or more fastening holes 94 (see FIGS. 2 and 3). By coupling one or more fastening members (not shown) with the fastening holes 94, the balancer 90 can be coupled to the upper portion of the main washing tub 30.

The auxiliary washing tub 100 may include second washing space 101. The auxiliary washing tub 100 may be detachably coupled to the main washing tub 30. In more detail, the auxiliary washing tub 100 may be detachably coupled to the balancer 90 coupled to the upper portion of the main washing tub 30.

In the following description, the meaning that the auxiliary washing tub 100 is installed in the main washing tub 30 may include a case in which the auxiliary washing tub 100 is seated on the main washing tub 30 and a case in which the auxiliary washing tub 100 is coupled to the main washing tub 30.

If the auxiliary washing tub 100 is installed in the main washing tub 30, the auxiliary washing tub 100 may rotate together with the main washing tub 30. In this case, the auxiliary washing tub 100 may wash laundry contained in the second washing space 101 separately from laundry contained in the first washing space 32.

A contact sensor (not shown) may be installed at a portion of the balancer 90 to determine whether the auxiliary washing tub 100 is installed in the main washing tub 30.

If the auxiliary washing tub 100 is separated from the main washing tub 30, the auxiliary washing tub 100 may be used as a basket for accommodating laundry therein before or after washing.

A water supply apparatus 50 for supplying water (washing water or rinsing water) to the main washing tub 30 and the auxiliary washing tub 100 may be installed in the upper portion of the cabinet 10.

The water supply apparatus 50 may include a water supply valve 51 to control water supply, a first water supply pipe 52 to connect the water supply valve 51 to a detergent supply device 60, a second water supply pipe 53 to connect the water supply valve 51 to a spray nozzle 55 for spraying water to the upper portion of the auxiliary washing tub 100, and a third water supply pipe 54 to connect the detergent supply device 60 to a water supply hole 21 placed in the tub 20.

One end of the water supply valve 51 may be connected to an external water supply source (not shown), and the other end of the water supply valve 51 may be connected to the first water supply pipe 52 and the second water supply pipe 53.

One end of the first water supply pipe 52 may be connected to the water supply valve 51, and the other end of the first water supply pipe 52 may be connected to the detergent supply device 60. Therefore, the first water supply pipe 52 may provide water (washing water) to the detergent supply device 60.

One end of the second water supply pipe 53 may be connected to the water supply valve 51, and the other end of the second water supply pipe 53 may be connected to the spray nozzle 55. The spray nozzle 55 may be disposed at the upper portion of the auxiliary washing tub 100. The spray nozzle 55 may provide water (washing water or rinsing water) to the auxiliary washing tub 100.

One end of the third water supply pipe 54 may be connected to the detergent supply device 60, and the other end of the third water supply pipe 54 may be connected to the water supply hole 21 formed in the tub 20. The third water supply pipe 54 may supply water in which detergent is dissolved, to the space between the tub 20 and the main washing tub 30, via the detergent supply device 60. Water flowing into the tub 20 through the third water supply pipe 54 may be stored in the main washing tub 30 through the through holes 33.

The detergent supply device 60 may be installed in the inside of the upper cover 15. The detergent supply device 60 may include a case 63 connected to the first water supply pipe 52, and a detergent container 61 detachably coupled to the case 62 to accommodate detergent therein. An outlet 65 for discharging water including detergent may be formed in the bottom of the case 63. The third water supply pipe 54 may be connected to the outlet 65. Water supplied through the first water supply pipe 52 may pass through the detergent supply device 60 and the third water supply pipe 54 to be supplied to the space between the main washing tub 30 and the tub 20 together with the detergent.

The driving apparatus 40 may include a clutch 41 to selectively rotate the main washing tub 30 and the pulsator 31, a motor 42 to drive the clutch 41, a flange member 43 to transfer a rotational force to the main washing tub 30 by connecting a driving shaft 41*a* of the clutch 41 to the bottom of the main washing tub 30, and a base plate 44 to fix the clutch 41 and the motor 42. In addition, the drive apparatus 40 may include a pulley 45 to fix the clutch 41 and the motor 42.

In the bottom of the tub 20, a drain apparatus 70 may be installed to discharge water to the outside of the cabinet 10 after a washing course or a dehydrating course is completed.

The drain apparatus 70 may include a drain hose 71 to guide water stored in the tub 20 to the outside of the cabinet 10, and a drain pump 72 to pump water stored in the tub 20. Although the embodiment has exemplarily disclosed the drain pump 72 for discharging water for convenience of description, the scope or spirit of the present disclosure is not limited thereto, and a drain motor or a drain valve may be installed.

Figure 2:
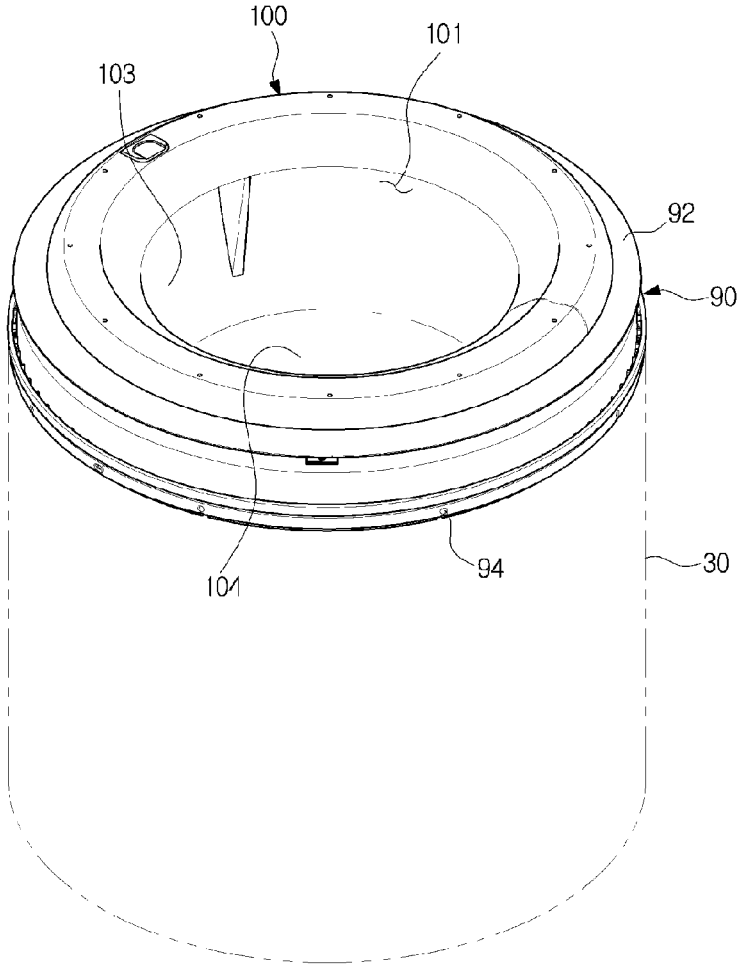
FIG. 2 is a view illustrating a washing machine in which an auxiliary washing tub is mounted to a balancer.
Figure 3:
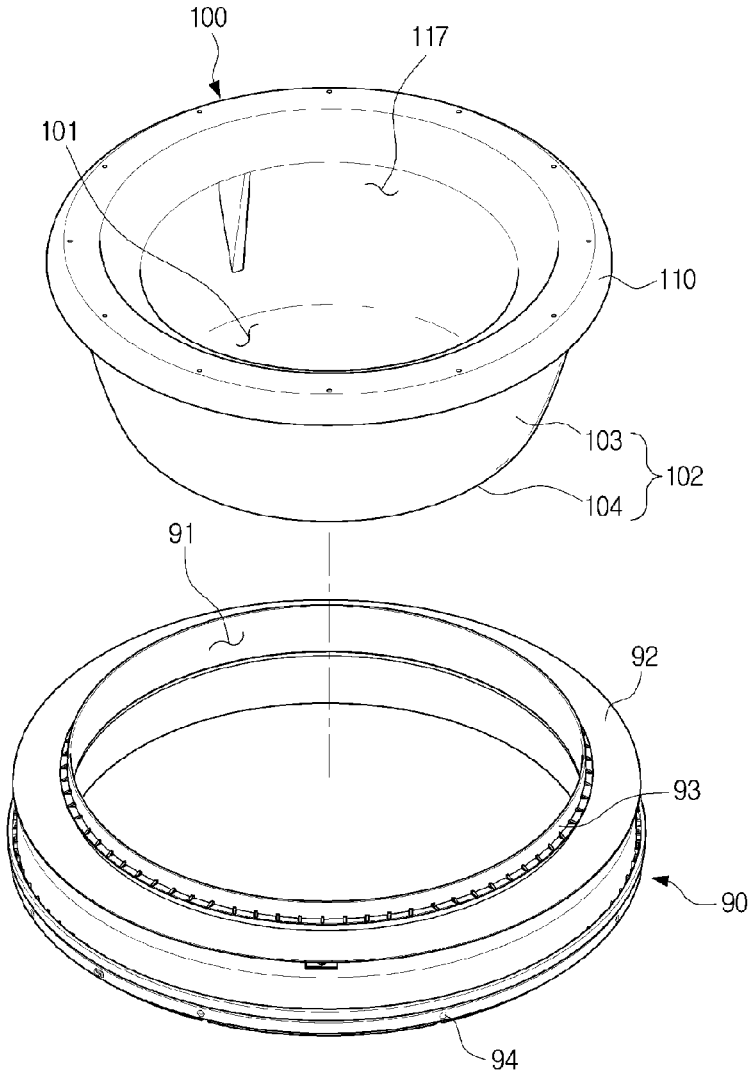
FIG. 3 is a view illustrating a washing machine in which the auxiliary washing tub and the balancer shown in FIG. 2 are separated from each other.

FIG. 2 shows a state in which the auxiliary washing tub is coupled to the balancer in the washing machine according to an embodiment of the present disclosure, and FIG. 3 shows a state in which the auxiliary washing tub and the balancer shown in FIG. 2 are separated from each other.

Referring to FIGS. 2 and 3, the auxiliary washing tub 100 may be detachably coupled to the balancer 90 disposed at the upper portion of the main washing tub 30. When a user wants to wash laundry separately, the user may couple the auxiliary washing tub 100 to the main washing tub 30. Since some kinds of laundry may make stain on other laundry or may cause certain problems when they are washed together with the other laundry in the main washing tub 30, the auxiliary washing tub 100 may be used to wash such laundry separately. That is, the main washing tub 30 may perform washing in the first washing space 31, and the auxiliary washing tub 100 may perform washing in the second washing space 101.

However, although laundry is washed separately in the main washing tub 30 and the auxiliary washing tub 100, laundry stored in the main washing tub 30 may get unavoidably stained or contaminated when water used in the auxiliary washing tub 100 is discharged to the inside of the main washing tub 30 during the dehydration course. In order to avoid the problem, the auxiliary washing tub 100 and the washing machine 1 including the same, according to an embodiment of the present disclosure, may include a drain flow passage to guide water used in the auxiliary washing tub 100 to the space between the main washing tub 30 and the tub 20. Therefore, since water used in the auxiliary washing tub 100 is immediately discharged to the outside of the main washing tub 30 during the dehydration course of the auxiliary washing tub 100, laundry accommodated in the main washing tub 30 may get neither stained nor contaminated due to water used in the auxiliary washing tub 100.

Figure 4:
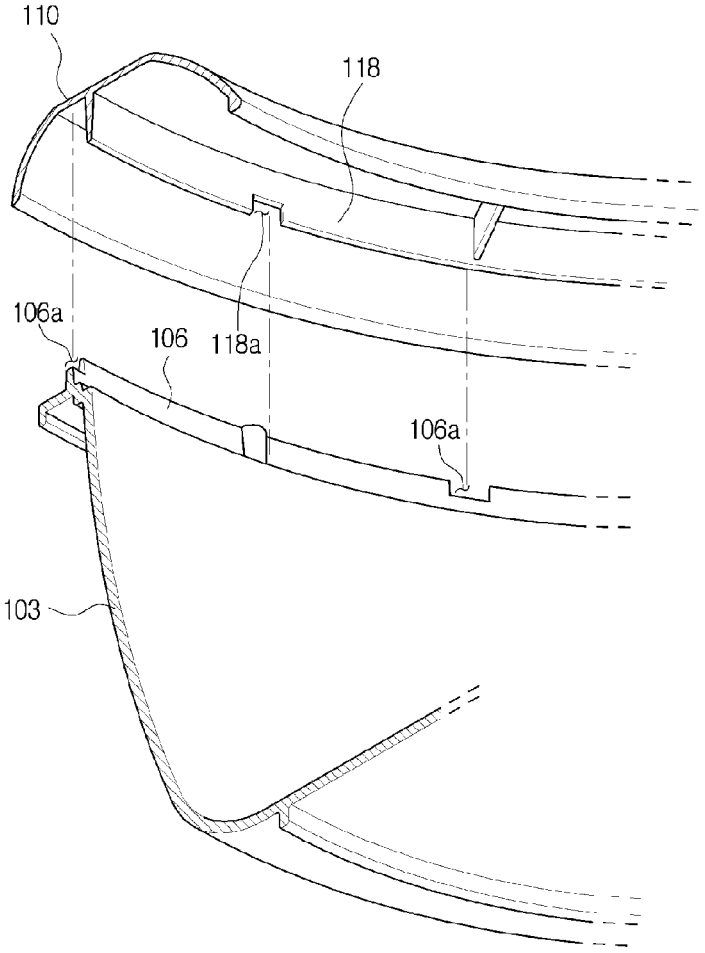
FIG. 4 is an exploded perspective view illustrating the auxiliary washing tub of the washing machine according to the embodiment of the present disclosure.
Figure 5:
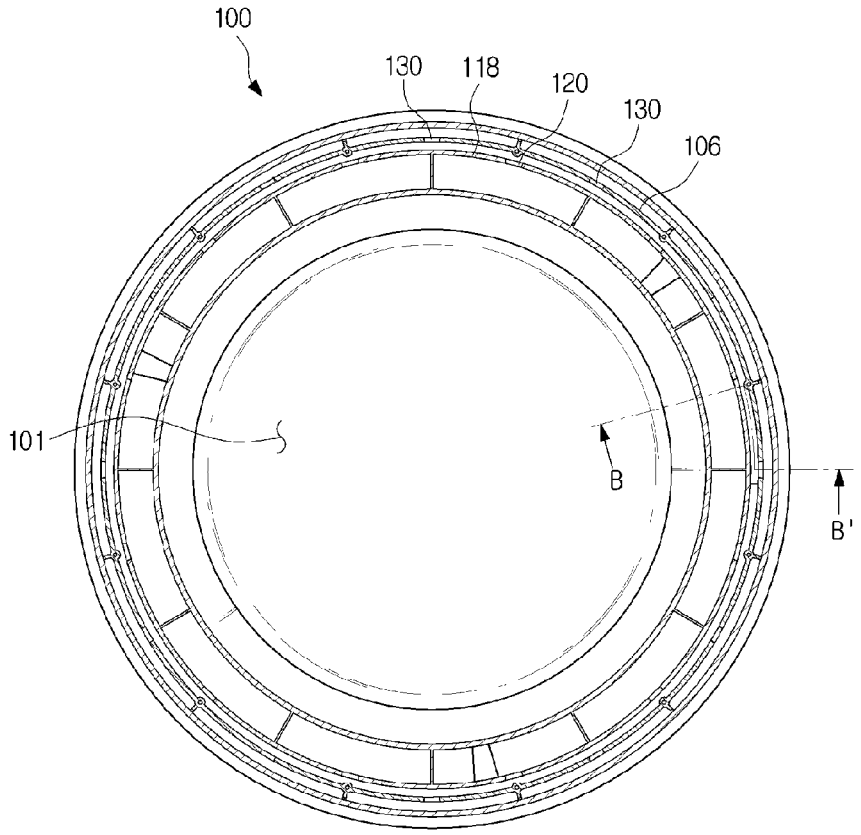
FIG. 5 is a cross-sectional view illustrating the auxiliary washing tub of the washing machine according to the embodiment of the present disclosure.
Figure 6:
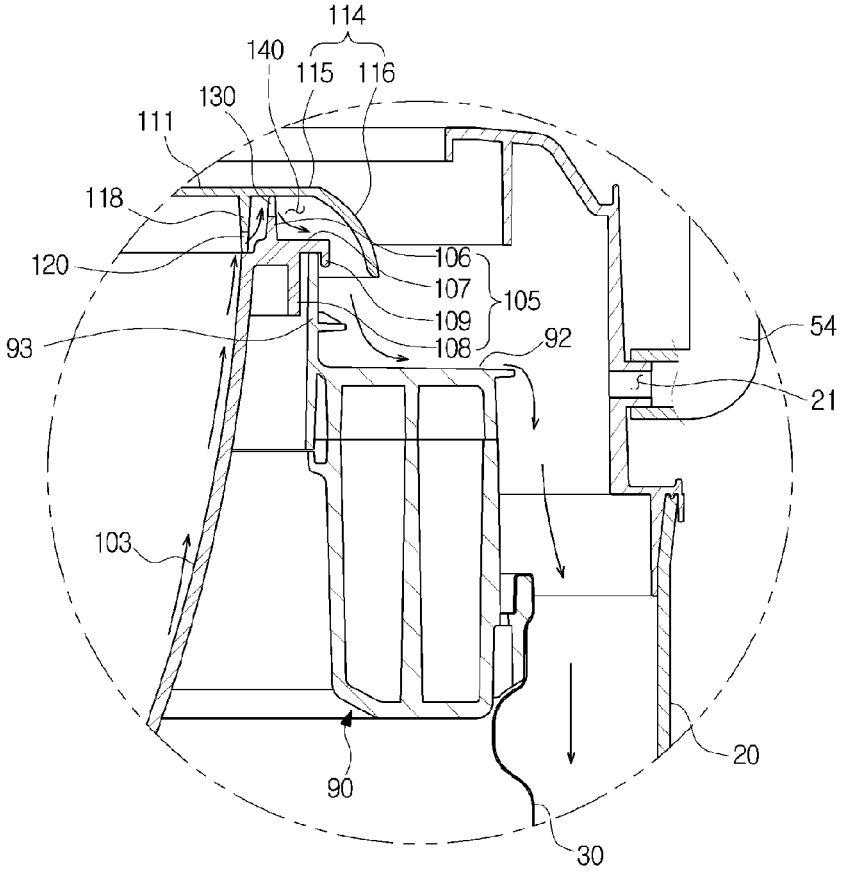
FIG. 6 is a cross-sectional view illustrating the auxiliary washing tub taken along the line B-B' shown in FIG. 5.

FIG. 4 is an exploded perspective view of the auxiliary washing tub of the washing machine according to the embodiment of the present disclosure. FIG. 5 is a cross-sectional view of the auxiliary washing tub of the washing machine according to the embodiment of the present disclosure. FIG. 6 is a cross-sectional view of the auxiliary washing tub shown in FIG. 5, taken along line B-B'.

In FIGS. 4 to 6, the auxiliary washing tub 100 may include a basket portion 102 forming the second washing space 101, and a cover portion 110 forming a laundry inlet 117.

The basket portion 102 may include a bottom wall 104 and a sidewall 103. The sidewall 103 may be tilted outward of the bottom wall 104 to guide water to one or more first drain holes 120 by a centrifugal force. Therefore, the cross-sectional area of the basket portion 102 may be greater at the upper part of the basket portion 102. Since the sidewall 103 is tilted, water stored in the auxiliary washing tub 100 may move to the upper portion of the sidewall 103 when the auxiliary washing tub 100 rotates. That is, water may move to the sidewall 103 by a centrifugal force, and the water moved to the sidewall 103 may flow to the upper portion of the sidewall 103 along a slope of the sidewall 103. Since the first drain holes 120 are formed in the upper portion of the sidewall 103, water passed through the first drain holes 120 may be discharged to the outside through the drain flow passage 140 which will be described later.

The basket portion 102 may further include a resting portion 105 rested on the upper end of the main washing tub 30. The resting portion 105 may extend outward from the sidewall 103. The resting portion 105 may be formed on the upper portion of the sidewall 103. In other words, the resting portion 105 may be an outer rim formed at the upper part of the basket portion 102.

The resting portion 105 may include a horizontal portion 107 extending vertically to the sidewall 103, and a first vertical portion 103 and a second vertical portion 109 extending downward from the horizontal portion 107. The horizontal portion 107 may be disposed approximately horizontally to the bottom wall 104. The horizontal portion 107 may be in the shape of a ring. The first vertical portion 108, the second vertical portion 109, and the horizontal portion 107 may form an insertion groove 109*a* into which the balancer 90 is inserted. A support rib 93 of the balancer 90 may be inserted into the insertion groove 109*a*. Since the support rib 93 of the balancer 90 is inserted into the insertion groove 109*a*, the auxiliary washing tub 100 may be rested on the upper end of the main washing tub 30.

The resting portion 105 may include a second barrier 106 forming the second drain hole 130 along with the cover portion 110. The second barrier 106 may extend upward from the horizontal portion 107. The second barrier 106 will be described later.

The cover portion 110 may be disposed in the upper portion of the basket portion 102. The cover portion 110 may include an inner cover portion 11, an outer cover portion 114, and a first barrier 118.

The first barrier 118 may be formed in the bottom surface of the cover portion 110. The first barrier 118 may extend downward from the bottom surface of the cover portion 110.

The first barrier 118 may include a first drain groove 118*a*. The first drain groove 118*a* may be formed by cutting out a part of the first barrier 118. The first drain groove 118*a* may be formed in an approximately rectangular shape in the bottom of the first barrier 118. Also, one or more first drain grooves 118*a* may be arranged at predetermined intervals along a circumferential direction of the first barrier 118.

The first drain groove 118*a* may be formed in various shapes. According to an embodiment of the present disclosure, the first drain groove 118*a* may be formed in an approximately rectangular shape although not limited to this. According to another example, the first drain groove 118*a* may be formed in the shape of a circle penetrating the first barrier 118.

The cover portion 110 may form the first drain hole 120 together with the sidewall 103. The first barrier 118 may be disposed to contact the upper end of the sidewall 103. When the first barrier 118 contacts the sidewall 103, the first barrier 118 may form the first drain hole 120. That is, when the cover portion 110 is coupled to the basket portion 102, the cover portion 110 and the sidewall 103 may form the first drain hole 120. In this case, the remaining part of the first barrier 118 except for the first drain groove 118*a* may prevent water from being discharged to the outside of the auxiliary washing tub 100, together with the sidewall 103.

The cover portion 110 may include an inner cover portion 111 extending inward from the basket portion 102. The inner cover portion 111 may be a part of the cover portion 110 extending inward of the basket portion 102 rather than the first barrier 118. The inner cover portion 111 may extend horizontally from the first barrier 118 toward the inside of the basket portion 102, and then be curved downward.

The inner cover portion 111 may include an inner horizontal portion and an inner curved portion. The inner horizontal portion may be a part of the inner cover portion 111 extending horizontally. The inner curved portion may be a part curved from one end of the inner horizontal portion. One end of the inner curved portion may be connected to the inner horizontal portion, and the other end of the inner curved portion may form the laundry inlet 117.

The inner cover portion 111 may guide water stored in the auxiliary washing tub 100 to flow to the first drain hole 120. When water stored in the auxiliary washing tub 100 flows to the first drain hole 120, the inner cover portion 111 may prevent water from flowing over the auxiliary washing tub 100. Water may not flow over the auxiliary washing tub 100 by the first barrier 118 and the inner cover portion 111 to flow into the first drain hole 120. That is, the inner cover portion 111 may guide water to the first drain hole 120, while preventing water from flowing over the auxiliary washing tub 100.

The cover portion 110 may include an outer cover portion 114 extending outward of the basket portion 102. The outer cover portion 114 may be a part of the cover portion 110 extending from the first barrier 118 to the outside of the basket portion 102. The outer cover portion 114 may extend horizontally from the first barrier 118 toward the outside of the basket portion 102 and then be curved downward. The outer cover portion 114 may cover the upper portion of the resting portion 105.

The outer cover portion 114 may include an outer horizontal portion 115 and an outer curved portion 116. The outer horizontal portion 115 may be a portion extending horizontally from the first barrier 118 toward the outside of the basket portion 102. The outer curved portion 116 may be a portion curved downward from one end of the outer horizontal portion 115.

The resting portion 105 may include a second barrier 106. The second barrier 106 may extend upward from the horizontal portion 107 so as to support the outer cover portion 114. The second barrier 106 may include a second drain groove 106*a*. The second drain groove 106*a* may be formed by cutting out a part of the second barrier 106. The second drain groove 106*a* may be formed in an approximately rectangular shape at the upper portion of the second barrier 106. One or more second drain grooves 106*a* may be arranged at predetermined intervals along the circumferential direction of the second barrier 106.

The second drain groove 106*a* may be formed in various shapes. According to an embodiment of the present disclosure, the second drain groove 106*a* may be formed in an approximately rectangular shape although not limited thereto. For example, the second drain groove 106*a* may be in the shape of a circle penetrating the second barrier 106.

The cover portion 110 may form the second drain hole 130 together with the resting portion 105. More specifically, the outer horizontal portion 115 may form the second drain hole 130 together with the second drain groove 106*a*. The second barrier 106 may contact the outer horizontal portion 115. When the second barrier 106 contacts the outer horizontal portion 115, the second drain groove 106*a* may form the second drain hole 130. That is, when the cover portion 110 is coupled to the basket portion 102, the cover portion 110 and the resting portion 105 may form the second drain hole 130.

The second drain hole 130 may be disposed above the first drain hole 120. In addition, the second drain hole 130 and the first drain hole 120 may be arranged alternately. That is, the first drain hole 120 and the second drain hole 130 may not be arranged on a straight line. The second barrier 106 may be disposed behind the first drain hole 120. Water stored in the auxiliary washing tub 100 may pass through the first drain hole 120 and then move between the first barrier 118 and the second barrier 106. Water may move between the first barrier 118 and the second barrier 106 and then flow into the second drain hole 130.

The outer cover portion 114 may guide water passed through the second drain hole 130 to the upper portion of the balancer 90, together with the resting portion 105. Water passed through the second drain hole 130 may be prevented from flowing over the auxiliary washing tub, by the outer horizontal portion 115, and may be guided to the upper portion of the balancer 90 by the outer curved portion 116. Meanwhile, the resting portion 105 may prevent water from flowing into the main washing tub 30.

The balancer 90 may include an opening 91 through which laundry is put into the main washing tub 30, a support rib 93 extending upward along the circumference of the opening 91, and a fastening hole 94.

The support rib 93 may extend upward from the top surface 92 of the balancer 90. The support rib 93 may be the upper end of the balancer 90. When the balancer 90 is coupled to the main washing tub 30, the support rib 93 may be the upper end of the main washing tub 30.

The support rib 93 may be configured to support the auxiliary washing tub 100. The support rib 93 may be inserted into the insertion groove 109*a* of the resting portion 105 so as to support the auxiliary washing tub 100.

The support rib 93 may prevent water guided by the drain flow passage 140 from flowing into the main washing tub 30. Since the support rib 93 extends upward from the top surface 92 of the balancer 90, and the auxiliary washing tub 100 is rested on the support rib 93, water guided to the top surface 92 of the balancer can be prevented from flowing into the main washing tub 30. That is, since the support rib 93 covers the entire of the opening 91 of the main washing tub 100 together with the auxiliary washing tub 100, no water can flow into the main washing tub 30 through the opening 91.

Hereinafter, a drain process and a drain flow passage of the auxiliary washing tub 100 will be described in detail.

Since the first drain hole 120 is formed in the upper portion of the sidewall 103, no centrifugal force may be applied to water stored in the second washing space 101 when the auxiliary washing tub 100 rotates at predetermined RPM or less, so that the water does not move to the upper portion of the sidewall 103. Therefore, the water stored in the second washing space 101 may be not drained to the outside of the auxiliary washing tub 100.

When the auxiliary washing tub 100 rotates at the predetermined RPM or more, a centrifugal force may be applied to the water stored in the second washing space 101, so that the water can move to the upper portion of the sidewall 103 along the tilted sidewall 103. One or more first drain holes 120 may be formed in the upper portion of the sidewall 103, so that the water can flow into the first drain holes 120. The water flowing into the first drain holes 120 may move along a flow passage formed by the first barrier 118 and the second barrier 106, and then flow into the second drain hole 130. The water passed through the second drain hole 130 may be guided to the upper portion of the balancer 90 by the resting portion 105 and the cover portion 110.

The auxiliary washing tub 100 may include a drain flow passage 140 to guide water of the second washing space 101 to the space between the tub 20 and the main washing tub 30.

The drain flow passage 140 may be formed by the resting portion 105 and the cover portion 110. The drain flow passage 140 may include the first drain hole 120, the space between the first barrier 118 and the second barrier 106, the second drain hole 130, and the space between the horizontal portion 107 and the outer cover portion 114. That is, the drain flow passage 140 may be a section through which water stored in the second washing space 101 moves to the upper portion of the sidewall 103, passes through the first drain hole 120, and is then guided to the upper portion of the balancer 90. Water stored in the second washing space 101 may be guided to the upper portion of the balancer 90 by the drain flow passage 140. A process in which the drain flow passage 140 guides water has been described above, and accordingly, a further description thereof will be omitted.

Water stored in the second washing space 101 may be guided to the top surface 92 of the balancer 90 by the drain flow passage 140, as described above. Water guided to the top surface 92 of the balancer cannot flow into the main washing tub 30 by the support rib 93, and the water can move to the outside of the main washing tub 30 by a centrifugal force generated when the main washing tub 30 rotates. Water moved to the outside of the main washing tub 30 may be guided to the space between the main washing tub 30 and the tub 20. Water guided to the space between the main washing tub 30 and the tub 20 may be discharged to the outside of the cabinet 10 through the drain hose 71.

Figure 7:
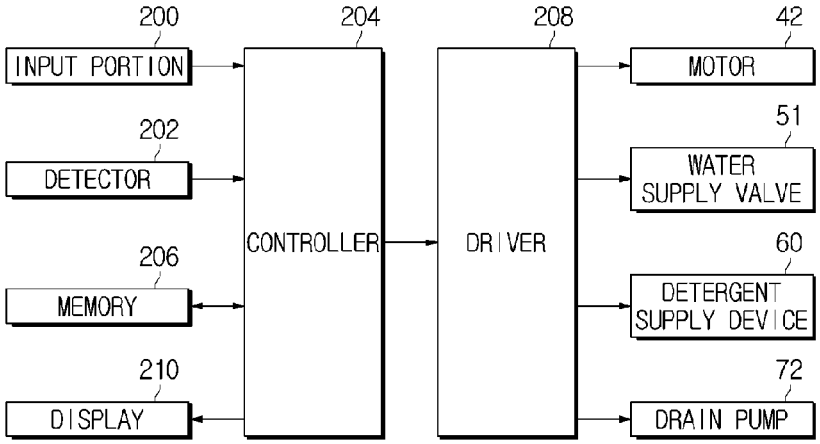
FIG. 7 is a block diagram illustrating a washing machine according to the embodiment of the present disclosure.

FIG. 7 is a control block diagram of the washing machine according to the embodiment of the present disclosure.

Referring to FIG. 7, the washing machine 1 may include an input portion 200, a detector 202, a controller 204, memory 206, a driver 208, and a display 210.

The input portion 200 may enable a user to input commands for executing a washing course, a rinsing course, and a dehydration course of the washing machine 1. The input portion 200 may be keys, buttons, switches, a touch pad, or the like, and may include any device of generating predetermined input data by pressing, touching, rotating, or the like.

In addition, the input portion 200 may include a plurality of buttons for enabling the user to input user commands (power on/off, reservation, temperature of washing water, soaking, washing, rinsing, dehydration, selection of a water level, etc.) related to operations of the washing machine 1. The plurality of buttons may include a course selection button for selecting a washing course (such as a standard course, a wool course, a boiling course, a drying course, etc.) according to the kinds of laundry put into the washing machine 1.

The detector 202 may include various sensors installed in the washing machine 1, such that the detector 200 can determine whether the auxiliary washing tub 100 is installed in the main washing tub 30 and can detect a water level of water stored in the tub 20 and an amount of water supplied to the auxiliary washing tub 100. The various sensors of the detector 202 may include an Infrared Ray (IR) contact sensor installed in a portion of the balancer 90 to detect a contact to the auxiliary washing tub 100, a water level sensor installed in the lower portion of the tub 20 to detect an amount of water (i.e., a water level) stored in the tub 20, a flowmeter to detect an amount of water supplied to the auxiliary washing tub 100 according to switched-on time of the water supply valve 51, etc. The IR contact sensor may determine whether the auxiliary washing tub 100 is installed when the auxiliary washing tub 100 rotates in one direction at 20 rpm, and determine whether the auxiliary washing tub 100 is in place.

The meaning that the auxiliary washing tub 100 is installed in the main washing tub 30 may include a case in which the auxiliary washing tub 100 is rested on the main washing tub 30, and a case in which the auxiliary washing tub 100 is coupled to the main washing tub 30.

The controller 204 may include one or more processors to control overall operations (such as a washing course, a rinsing course, and a dehydration course) of the washing machine 1 according to operation information received from the input portion 200.

The controller 204 may set an amount of water for washing (a target water level for washing), an amount of water for rinsing (a target water level for rinsing), RPM of the motor 42, and an operation rate (ON-OFF time) of the motor 42, washing time, the number of rinsing, etc. according to a weight (load) of laundry in the selected washing course.

In addition, the controller 204 may detect a weight of laundry contained in the main washing tub 30 according to driving of the motor 42, before a washing course is executed after the laundry is put into the main washing tub 30. As an example of a method for detecting a weight of laundry, a method of accelerating the main washing tub 30 containing laundry to predetermined speed by driving the motor 42, then applying predetermined torque (or a predetermined voltage) to the main washing tub 30 to measure acceleration time taken for the main washing tub to reach the predetermined speed, and detecting a weight of the laundry using the acceleration time may be used. Since acceleration time is proportional to a weight of laundry, the controller 204 can estimate a weight of the laundry using a weight reference table corresponding to acceleration time.

Additionally, the controller 204 may determine whether the auxiliary washing tub 100 is installed through the detector 202, and may determine whether the main washing tub 30 accommodates laundry therein by detecting a weight of the main washing tub 30.

Therefore, the controller 204 may selectively execute one of a simultaneous washing mode, an independent washing mode of the main washing tub 30, and an independent washing mode of the auxiliary washing tub 100, according to whether or not the auxiliary washing tub 100 is installed and the detected weight of the main washing tub 30.

The controller 204 may perform an optimum washing algorithm obtained by combination of a rotation of the pulsator 31 and a rotation of the main washing tub 30, according to the simultaneous washing mode and the independent washing mode (an independent main washing mode or an independent auxiliary washing mode). The washing algorithm will be described with reference to FIGS. 8A and 8B, later.

The memory 206 may store control data for controlling operations of the washing machine 1, reference data used in controlling operations of the washing machine 1, operation data generated when the washing machine 1 performs predetermined operation, setting information such as setting data inputted by the input portion 200 such that the washing machine 1 performs predetermined operation, the number of times by which the washing machine 1 performs specific operation, information about the washing machine 1 including model information of the washing machine 1, and malfunction information including a cause of malfunction or a location at which malfunction occurs when the washing machine 1 malfunctions.

In addition, the memory 206 may be implemented as a non-volatile memory device, such as Read Only Memory (ROM), Programmable Read Only Memory (PROM), Erasable Programmable Read Only Memory (EPROM), or flash memory, a volatile memory device such as Random Access Memory (RAM), or a storage device, such as a hard disk or an optical disk. However, the memory 206 is not limited thereto, and may also be implemented as any one of other storage devices known to those skilled in the art.

The driver 208 may drive the motor 42, the water supply valve 51, the detergent supply device 60, the drain pump 72, etc., related to operations of the washing machine 1 according to a driving control signal from the controller 204.

The display 210 may display an operation state of the washing machine 1 according to a display control signal from the controller 204, and may display a user's manipulation state by recognizing operation information input through the input portion 200. The display 210 may be implemented as any one of a Liquid Crystal Display (LCD) panel, a Light Emitting Diode (LED) panel, etc.

The operation processes and effects of the washing machine, and a method for controlling the washing machine, according to an embodiment of the present disclosure, will hereinafter be described in detail.

Prior to describing an embodiment of the present disclosure, a case in which a simultaneous washing mode is performed in both the main washing tub 30 and the auxiliary washing tub 100 will hereinafter be referred to as a first washing mode, a case in which an independent washing mode is performed only in the auxiliary washing tub 100 will hereinafter be referred to as a second washing mode, and a case in which an independent washing mode is performed only in the main washing tub 30 will hereinafter be referred to as a third washing mode.

When the auxiliary washing tub 100 is installed in the main washing tub 30, the first washing mode or the second washing mode may be carried out. When the auxiliary washing tub 100 is not installed in the main washing tub 30, only the third washing mode may be carried out.

Figure 8A:
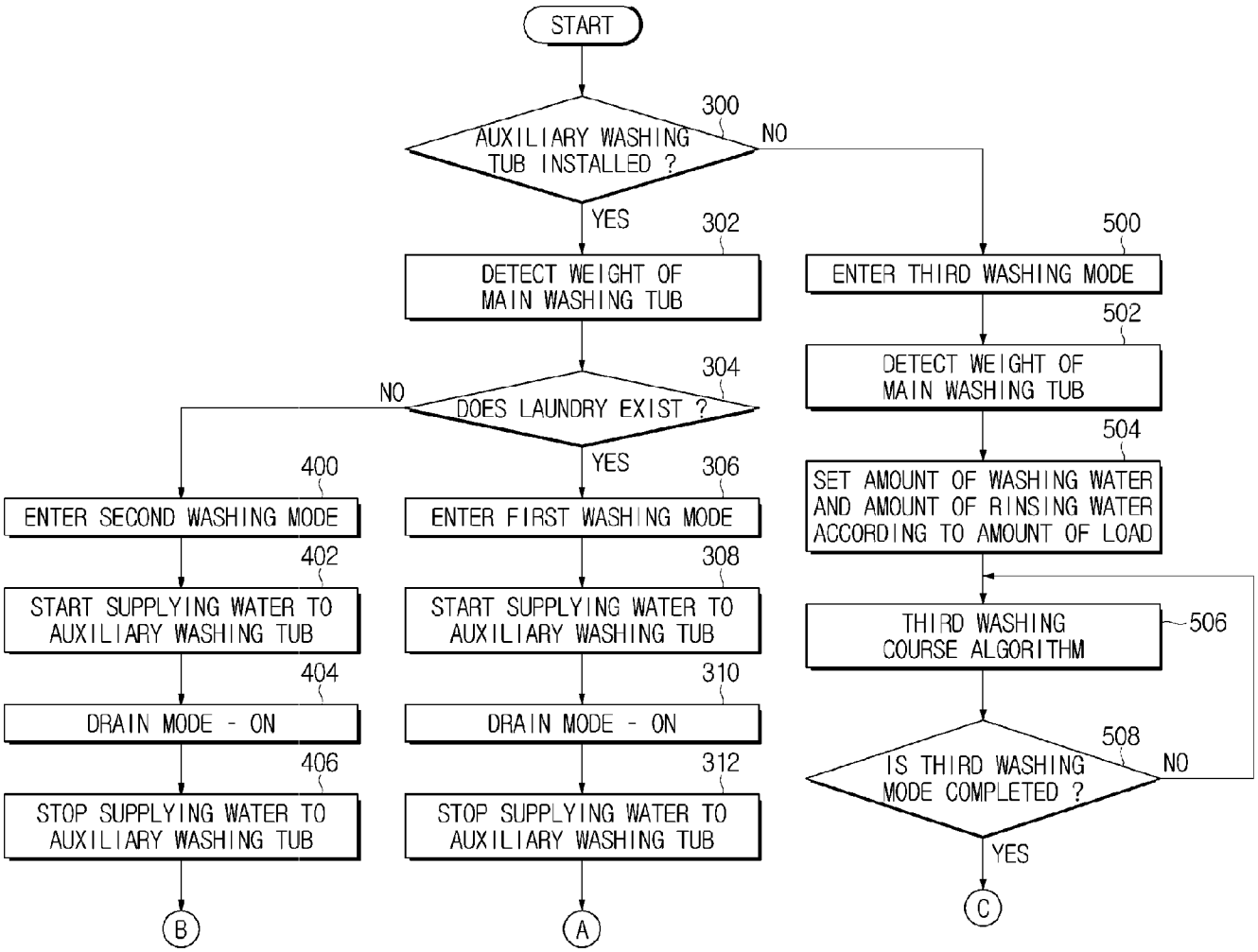
FIGS. 8A and 8B are flowcharts illustrating a separate washing control algorithm of the washing machine according to the embodiment of the present disclosure.
Figure 8B:
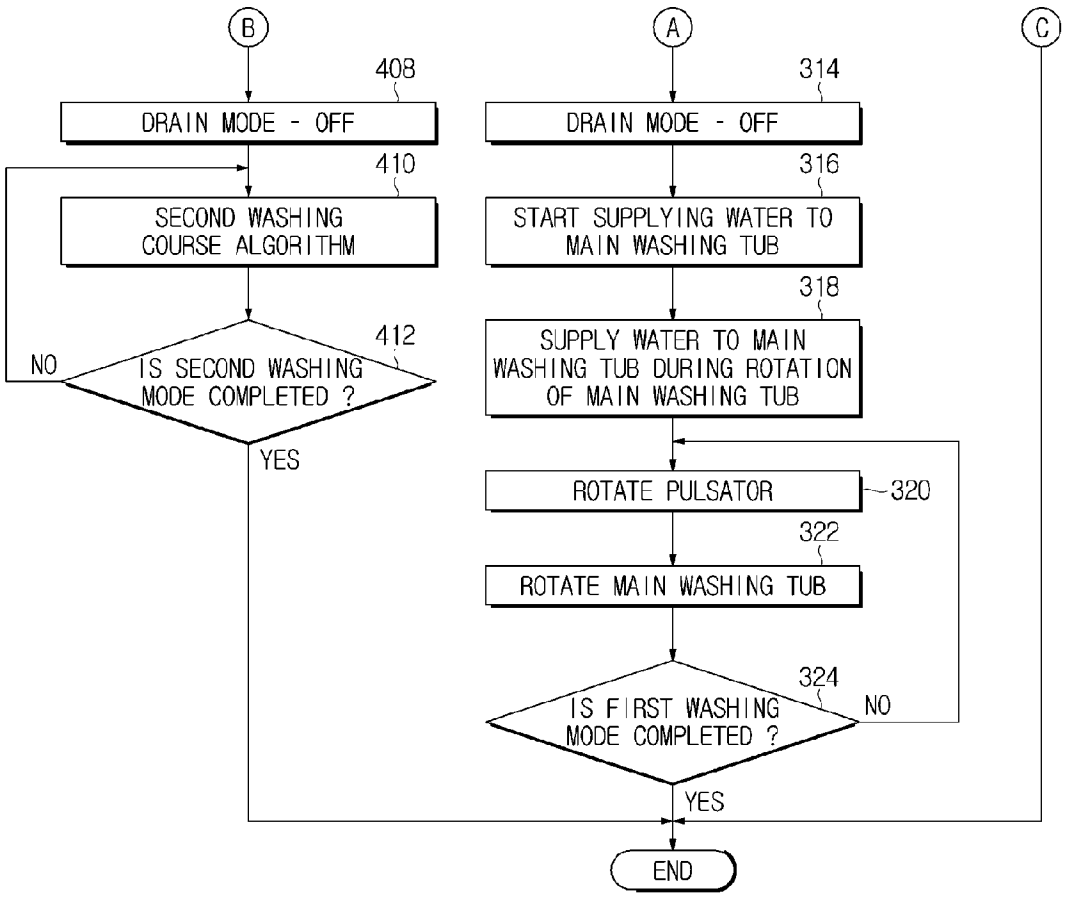

FIGS. 8A and 8B are flowcharts illustrating a separate washing control algorithm of the washing machine according to the embodiment of the present disclosure. FIG. 9 shows a washing course profile obtained by a combination of a rotation of the pulsator and a rotation of the main washing tub in a simultaneous washing mode of the washing machine according to the embodiment of the present disclosure.

Referring to FIGS. 8A and 8B, the user may open the door 16, put laundry into the main washing tub 30 through the inlet 14, and select a washing course (a standard course, a wool course, a delicate course, a boiling course, etc. from among a plurality of washing courses) and operation information related to operation of the washing machine 1, according to the kind of the laundry. The operation information selected by the user may be input to the controller 204 through the input portion 200.

In addition, the user may classify laundry according to the weight or kind of laundry, and may put the classified laundry into the auxiliary washing tub 100.

The controller 204 may perform washing through the main washing tub 30 and the auxiliary washing tub 100 according to the washing course input by the input portion 200.

In this case, the controller 204 may determine whether the auxiliary washing tub 100 is installed in the main washing tub 30, before performing washing through the main washing tub 30 and the auxiliary washing tub 100, in operation 300.

When the controller 204 determines in operation 300 that the auxiliary washing tub 100 is installed in the main washing tub 30, the controller 204 may detect a weight (load) of laundry put in the main washing tub 30 so as to perform the first washing mode or the second washing mode, in operation 302. There are various methods for detecting a weight of laundry. For example, a method of applying a predetermined duty (90V) to the motor 42 while rotating the motor 42 at rpm (about 70~150 rpm) for weight detection, and measuring time taken for the motor 42 to reach the predetermined duty and angular speed of the motor 42 when the motor 42 reaches the predetermined duty to detect a weight of laundry using the time and the angular speed, a method of measuring time taken for the motor 42 to reach predetermined speed (or predetermined rpm) using instantaneous acceleration of the motor 42 to detect a weight of laundry using the time, or a method of applying torque to the motor 42 for a predetermined time period to measure an amount of inertia of the main washing tub 30 directly or indirectly, and then detecting a weight of laundry using the second law of motion (torque=intertia×acceleration), as disclosed in Japanese Patent Laid-open Publication No. 2002-336593, Japanese Patent Laid-open Publication No. 2004-267334, and Japanese Patent Publication No. Heisei 07-90077, may be applied.

Also, a well-known method of detecting a weight (load) of laundry using a load cell may be used.

As described above, the controller 204 may detect a weight of the main washing tub 30 to determine whether laundry is accommodated in the main washing tub 30, in operation 304.

If the controller 204 determines in operation 304 that laundry is contained in the main washing tub 30, the controller 204 may enter the first washing mode to perform simultaneous washing in both the main washing tub 30 and the auxiliary washing tub 100, in operation 306.

In the first washing mode, water (washing water) may be supplied to the auxiliary washing tub 100 through water-supply operation for controlling the amount of water, and water (washing water) may be supplied to the main washing tub 30 through water-supply operation for controlling a water level.

The first washing mode will be described in detail, as follows.

First, the controller 204 may switch on the water supply valve 51 and the spray nozzle 55 to supply water (washing water) to the auxiliary washing tub 100.

If the water supply valve 51 is switched on, the water supply valve 51 may open to supply water (washing water) to the auxiliary washing tub 100 through the spray nozzle 55 via the second water supply pipe 53. In this case, the controller 204 may control water-supply operation through centrifugal rotation water-supply of rotating the auxiliary washing tub 100 centrifugally to supply water (washing water), and start water-amount control water-supply of measuring switched-on time of the water supply valve 51 to control an amount of water that is supplied to the auxiliary washing tub 100, in operation 308.

Water supplied into the second washing space 101 of the auxiliary washing tub 100 may move to the upper portion of the sidewall 103 by a centrifugal force, and the water moved to the sidewall 103 may move to the upper portion of the sidewall 103 along the slope of the sidewall 103. Since the first drain hole 120 is formed in the upper portion of the sidewall 103, water passed through the first drain hole 120 may be drained through the drain flow passage 140 so that a drain mode of the auxiliary washing tub 100 is turned on, in operation 310.

Subsequently, the controller 204 may measure an amount of water supplied to the auxiliary washing tub 100 according to the switched-on time of the water supply valve 51. When an appropriate amount of water (washing water) is supplied to the auxiliary washing tub 100, the controller 204 may stop the water-amount control water-supply for controlling an amount of water that is supplied to the auxiliary washing tub 100, in operation 312.

When the water-amount control water-supply for controlling the amount of water that is supplied to the auxiliary washing tub 100 stops, the drain mode of the auxiliary washing tub 100 may be turned off, in operation 314.

Although the embodiment has exemplarily disclosed the method for controlling an amount of water that is supplied to the auxiliary washing tub 100 by measuring the switched-on time of the water supply valve 51, the scope or spirit of the present disclosure is not limited thereto. As another example, a flowmeter (not shown) may be installed at a predetermined position of the second water supply pipe 53 to control an amount of water that is supplied to the auxiliary washing tub 100.

Subsequently, the controller 204 may switch on the water supply valve 51 so as to supply water (washing water) to the main washing tub 100.

If the water supply valve 51 is switched on, the water supply valve 51 may open to supply water (washing water) to the main washing tub 30 through the third water supply pipe 54 via the first water supply pipe 52 and the detergent supply device 60, in operation 316. In this case, the controller 204 may control water supply operation through rotational water-supply for supplying water (washing water) while rotating the main washing tub 30 to increase a wetting force (or a wetting degree) of laundry, in operation 318. As a result, laundry contained in the main washing tub 30 can be evenly wetted.

Subsequently, the controller 204 may detect a water level of water supplied to the main washing tub 30 using a water level sensor (not shown). when water supplied to the main washing tub 30 reaches a target water level (i.e., a water level decided by an amount of load or a water level decided by an amount of wash water), the controller 204 may stop the water-level control water-supply for controlling a water level of water that is supplied to the main washing tub 30.

As described above, when water (washing water) is supplied to the auxiliary washing tub 100 through the water-amount control water-supply, and water (washing water) is supplied to the main washing tub 30 through the water-level control water-supply, the controller 204 may drive the motor 42 to rotate the pulsator 31 horizontally during a first time period (about 4 minutes), in operation 320.

According to the horizontal rotation of the pulsator 31, the motor 42 may rotate forward or backward for a first time period (about 4 minutes) at the rpm (about 120 rpm) of the motor 42 and predetermined operation rate (On for 1.1 seconds/OFF for 0.8 seconds), as shown in "Washing 1" of FIG. 9, so that the pulsator 31 rotates in a first direction and then rotates in a second direction that is opposite to the first direction alternately to agitate water and laundry in a left-right direction. According to the horizontal rotation of the pulsator 31, the laundry accommodated in the main washing tub 30 may be agitated together with water (washing water including detergent) so that a washing course of removing contaminants from the laundry may be executed, and the laundry accommodated in the auxiliary washing tub 100 may remain soaked.

When the horizontal rotation of the pulsator 31 is completed after the first time period (about 4 minutes) has elapsed, the controller 204 may drive the motor 42 to rotate the main washing tub 30 in the left-right direction for a second time period (about 3 minutes), in operation 322.

According to the horizontal rotation of the main washing tub 30, the motor 42 may rotate forward or backward for the second time period (about 3 minutes) at the rpm (about 90 rpm) of the motor 42 and predetermined operation rate (ON for 2.5 seconds/OFF for 3.0 seconds) of the motor 42, as shown in "Washing 2" of FIG. 9, so that the main washing tub 30 may rotate in the first direction and then rotates in the second direction that is opposite to the first direction alternately to agitate the laundry and water in the left-right direction. According to the horizontal rotation of the main washing tub 30, a washing course of reducing damage on the laundry of the main washing tub 30 and the laundry of the auxiliary washing tub 100 may be carried out.

Subsequently, the controller 204 may determine whether the washing course of the first washing mode is completed, in operation 324. When the controller 204 determines that the washing course of the first washing mode is not completed, the controller 204 may return to the operation 320 to perform alternate washing of repeatedly performing a horizontal rotation (Washing 1) of the pulsator 31 and a horizontal rotation (Washing 2) of the main washing tub 30 until the washing course of the first washing mode is completed.

When the controller 204 determines in operation 324 that the washing course of the first washing mode is completed, the controller 204 may finish the operation of the first washing mode.

Although the embodiment of the present disclosure has exemplarily disclosed that the alternate washing operation (Washing 1→Washing 2→Washing 1→Washing 2→Washing 1→Washing 2→ . . . ) is performed in the first washing mode such that a horizontal rotation (Washing 1) of the pulsator 31 and a horizontal rotation (Washing 2) of the main washing tub 30 are repeatedly performed until the washing course is completed, the scope or spirit of the first washing mode is not limited thereto, and it should be noted that alternate washing (Washing 1→Washing 2→Washing 3→Washing 4→Washing 5→Washing 6→ . . . ) in which a horizontal rotation (Washing 1, Washing 3, Washing 5, . . . ) of the pulsator 31 and a horizontal rotation (Washing 2, Washing 4, Washing 6, . . . ) of the main washing tub 30 are sequentially carried out until the washing course is completed can also be applied to the embodiment of the present disclosure without departing from the scope or spirit of the present disclosure.

Meanwhile, when the controller 204 determines in operation 304 that no laundry exists in the main washing tub 30, the controller 204 may enter a second washing mode to perform washing only in the auxiliary washing tub 100, in operation 400.

The second washing mode may be a washing mode in which independent washing is performed only in the auxiliary washing tub 100 to wash laundry accommodated in the auxiliary washing tub 100 using a horizontal rotation of the main washing tub 30.

In order to supply water (washing water) to the auxiliary washing tub 100, the controller 204 may switch on the water supply valve 51 and the spray nozzle 55.

If the water supply valve 51 is switched on, the water supply valve 51 may open to supply water (washing water) to the auxiliary washing tub 100 through the spray nozzle 55 via the second water supply pipe 53. In this case, the controller 204 may control water-supply operation through centrifugal rotation water-supply of supplying water (washing water) while rotating the auxiliary washing tub 100 centrifugally, and start water-amount control water-supply of measuring switched-on time of the water supply valve 51 to control an amount of water that is supplied to the auxiliary washing tub 100, in operation 402.

The water supplied into the second washing space 101 of the auxiliary washing tub 100 may move to the upper portion of the sidewall 103 by a centrifugal force, and the water supplied to the sidewall 103 may move to the upper portion of the sidewall 103 along the slope of the sidewall 103. Since the first drain hole 120 is formed in the upper portion of the sidewall 103, water passed through the first drain hole 120 may be drained through the drain flow passage 140, so that the drain mode of the auxiliary washing tub 100 is turned on, in operation 404.

Subsequently, the controller 204 may measure an amount of water supplied to the auxiliary washing tub 100 according to the switched-on time of the water supply valve 51. When an appropriate amount of water (washing water) is supplied to the auxiliary washing tub 100, the controller 204 may stop the water-amount control water-supply for controlling an amount of water supplied to the auxiliary washing tub 100, in operation 406.

If the water-amount control water-supply for controlling the amount of water supplied to the auxiliary washing tub 100 stops, the drain mode of the auxiliary washing tub 100 may be turned off, in operation 408.

When an appropriate amount of water is supplied to the auxiliary washing tub 100, the controller 204 may drive the motor 42 to rotate the main washing tub 30 in the left-right direction, thereby performing the washing course algorithm of the second washing mode for the independent washing of the auxiliary washing tub 100, in operation 410.

Subsequently, the controller 204 may determine whether the washing course of the second washing mode is completed, in operation 412. When the controller 204 determines that the washing course of the second washing mode is not yet completed, the controller 204 may return to operation 410 to perform the next operations subsequent to the operation 410.

If the controller 204 determines in operation 412 that the washing course of the second washing mode is completed, the controller 204 may finish the operation of the second washing mode.

Meanwhile, when the controller 204 determines in operation 300 that the auxiliary washing tub 100 is not installed in the main washing tub 30, the controller 204 may enter a third washing mode to perform washing only in the main washing tub 30, in operation 500.

The third washing mode may be a washing mode in which independent washing is performed only in the main washing tub 30 in the same manner as in the conventional fully automatic washing machine.

First, the controller 204 may detect a weight of laundry (load) accommodated in the main washing tub 30 in order to perform the third washing mode, in operation 502. The method for detecting the weight of laundry may be the same method as that described above in operation 302, and accordingly, a further description thereof will herein be omitted.

When the weight (load) of laundry is detected, the controller 204 may set an amount of water (i.e., a target water level), an amount of rinsing water (i.e., a target rinsing water level), rpm of the motor 42, an operation rate (ON/OFF time of the motor 42) of the motor 42, washing time, the number of rinsing, etc. according to the detected weight (load) of laundry, in operation 504.

The above-mentioned operation for setting the amount of water (i.e., a target water level), the amount of rinsing water (i.e., a target rinsing water level), the rpm of the motor 42, the operation rate (ON/OFF time of the motor 42) of the motor 42, the washing time, the number of rinsing, etc. according to the weight (load) of laundry may correspond to a case in which a user inputs no additional command for operations of the washing machine 1. when the user inputs an additional command for operations of the washing machine 1, the rpm of the motor 42, the operation rate (ON/OFF time of the motor 42) of the motor 42, the target water level, the target rinsing water level, the washing time, the rinsing time, etc. set according to the weight of the laundry may change according to the user's command.

Therefore, the controller 204 may perform the washing course algorithm of the third washing mode for performing independent washing of the main washing tub 30, in operation 506.

Subsequently, the controller 204 may determine whether the washing course of the third washing mode is completed, in operation 508. When the controller 204 determines that the washing course of the third washing mode is not completed, the controller 204 may return to operation 506 to perform the next operations subsequent to the operation 506.

When the controller 204 determines in operation 508 that the washing course of the third washing mode is completed, the controller 204 may finish the operation of the third washing mode.

The washing course profile of the first washing mode, as shown in FIG. 9, illustrates an exemplary case in which the main washing tub 30 and the auxiliary washing tub 100 perform the standard course. In this case, the operation rate and the operation time of the main washing tub 30 and the operation rate and the operation time of the auxiliary washing tub 100 may be changed according to a weight (load) of laundry and a combination of courses.

Although the embodiment of the present disclosure has exemplarily disclosed the washing course, the scope or spirit of the present disclosure is not limited thereto, and it is also possible to reduce damage on clothes and improve the rinsing performance using a rinsing profile for changing the operation rate and operation time of rpm for rinsing according to a weight of laundry and a combination of courses in the rinsing course.

As is apparent from the above description, according to the washing machine and the method for controlling the same, by providing the main washing tub and the auxiliary washing tub to wash laundry separately according to the amount or kinds of the laundry, it is possible to remove inconvenience of operating the washing machine several times, and to reduce wastes of time and energy.

In addition, by selectively executing one of the simultaneous washing mode of simultaneously operating the main washing tub and the auxiliary washing tub, the independent washing mode of operating only the main washing tub 30 independently, and the independent washing mode of operating only the auxiliary washing tub 100 independently, it is possible to effectively wash laundry separately in the main washing tub and the auxiliary washing tub according to an optimum washing algorithm obtained by a combination of a rotation of the washing tub and a rotation of the pulsator, and to improve the washing performance while reducing damage on clothes.

The above-mentioned embodiments are disclosed only for illustrative purposes. The above-mentioned disclosures are used only to indicate the embodiments, and the present disclosure can also be used in various combinations, modifications and environments without departing from the scope or spirit of the present disclosure. That is, the present disclosure can be readily modified or changed within the scope of the present disclosure, within the scope equivalent to the disclosed content, and/or within the scope of technology or knowledge well known to those skilled in the art. The above-mentioned embodiments have exemplarily described the best mode for implementing a technical idea of the present disclosure, and various modifications needed for detailed application fields and utilities can also be made available. Therefore, the above-mentioned embodiments are exemplary and explanatory and are not intended to limit the scope of the present disclosure. In addition, the appended claims may conceptually include other embodiments or examples without departing from the scope or spirit of the present disclosure as necessary.

Although a few embodiments of the present disclosure have been shown and described, it would be appreciated by those skilled in the art that changes may be made in these embodiments without departing from the principles and spirit of the invention, the scope of which is defined in the claims and their equivalents.

The invention claimed is:

1. A washing machine comprising:

a cabinet;

a tub disposed in the cabinet, and configured to accommodate water therein;

a main washing tub rotatably disposed in the tub, and including a first washing space to accommodate laundry therein;

a pulsator rotatably disposed in the main washing tub;

an auxiliary washing tub rotatably disposed in the tub, detachably coupled to the main washing tub, and including a second washing space to accommodate laundry therein;

a motor configured to rotate at least one of the pulsator and the main washing tub;

an input portion configured to select a washing course; and a controller configured to control the motor to alternately rotate the pulsator and the main washing tub when performing a washing operation in a state in which the auxiliary washing tub is coupled to the main washing tub, wherein, when controlling the motor, the controller is further configured to:

detect a weight of the laundry in the main washing tub by rotation control of the motor, and change an operation rate and an operation time of the motor for rotating the pulsator, and an operation rate and an operation time of the motor for rotating the main washing tub based on the washing course received by the input portion and the detected weight of the laundry.

2. The washing machine of claim 1, further comprising a detector configured to determine whether the auxiliary washing tub is coupled to the main washing tub, wherein the controller is further configured to:

determine whether laundry is accommodated in the main washing tub based on the detected weight of the laundry, and control the motor to alternately rotate the pulsator and the main washing tub when determined that the laundry is accommodated in the main washing tub and the auxiliary washing tub is coupled to the main washing tub.

3. The washing machine of claim 2, wherein the controller is further configured to control the motor to rotate the main washing tub when it is determined that no laundry is accommodated in the main washing tub and the auxiliary washing tub is coupled to the main washing tub.

4. The washing machine of claim 2, wherein, when it is determined that the auxiliary washing tub is not coupled to the main washing tub, the controller is further configured to perform washing independently in the main washing tub.

5. The washing machine of claim 1, further comprising a water supply apparatus installed in an upper portion of the cabinet, and configured to supply water to the main washing tub and the auxiliary washing tub, wherein the controller is further configured to:

supply water to the auxiliary washing tub by controlling an amount of water to be supplied from the water supply apparatus, and supply water to the main washing tub by controlling a water level of the tub.

6. The washing machine of claim 5, wherein the controller is further configured to perform rotational water-supply operation for wetting the laundry by rotating the main washing tub when water is supplied to the main washing tub.

7. The washing machine of claim 1, wherein, when controlling the motor to rotate the pulsator, the controller is further configured to control a rotation direction of the motor to rotate the pulsator in a first direction and in a second direction that is opposite to the first direction alternately for a predetermined time period.

8. The washing machine of claim 1, wherein, when controlling the motor to rotate the main washing tub, the controller is further configured to control a rotation direction of the motor to rotate the main washing tub in a first direction and in a second direction that is opposite to the first direction alternately for a predetermined time period.

9. A method for controlling a washing machine, the washing machine including a tub, a main washing tub rotatably disposed in the tub to accommodate laundry therein, a pulsator rotatably disposed in the main washing tub, an auxiliary washing tub detachably coupled to the main washing tub to accommodate laundry therein, and a motor configured to rotate at least one of the pulsator and the main washing tub, the method comprising:

determining whether the auxiliary washing tub is coupled;

detecting, when the auxiliary washing tub is coupled, a weight of the laundry accommodated in the main washing tub to determine whether laundry is accommodated in the main washing tub; and controlling, when it is determined that laundry is accommodated in the main washing tub, the motor to alternately rotate the pulsator and the main washing tub, wherein the controlling of the motor includes changing an operation rate and an operation time of the motor for rotating the pulsator and an operation rate and an operation time of the motor for rotating the main washing tub based on a washing course received by an input portion and the detected weight of the laundry.

10. The method of claim 9, further comprising performing, when the auxiliary washing tub is not coupled in the main washing tub, washing independently in the main washing tub.

11. The method of claim 9, further comprising, performing, when no laundry exists in the main washing tub, washing independently in the auxiliary washing tub.

12. The method of claim 9, further comprising:

supplying water to the auxiliary washing tub by controlling an amount of water to be supplied to the auxiliary washing tub; and supplying water to the main washing tub by controlling a water level of water to be supplied to the main washing tub.

13. The method of claim 12, further comprising controlling rotation of the main washing tub to wet the laundry in the main washing tub and the laundry in the auxiliary washing tub with water, when supplying water to the main washing tub.

14. The method of claim 9, wherein rotating of the pulsator of controlling the motor to alternately rotate the pulsator and the main washing tub comprises rotating the pulsator in a first direction and in a second direction that is opposite to the first direction alternately for a predetermined time period.

15. The method of claim 9, wherein rotating of the main washing tub of controlling the motor to alternately rotate the pulsator and the main washing tub comprises rotating the main washing tub in a first direction and in a second direction that is opposite to the first direction alternately during a predetermined time period.

* * * * *